US010023383B2

(12) United States Patent
Cardoso Cabral Martins Da Silva et al.

(10) Patent No.: US 10,023,383 B2
(45) Date of Patent: Jul. 17, 2018

(54) SUBSURFACE SYSTEM FOR THE COLLECTION OF REFUSE

(71) Applicant: ASFC SGPS, S.A., Oporto (PT)

(72) Inventors: Nuno Filipe Cardoso Cabral Martins Da Silva, Oporto (PT); Fernando Manuel Martins Fernandes, Oporto (PT)

(73) Assignee: ASFC SGPS, S.A., Oporto (PT)

( * ) Notice: Subject to any disclaimer, the term of this patent is extended or adjusted under 35 U.S.C. 154(b) by 470 days.

(21) Appl. No.: 14/439,230

(22) PCT Filed: Oct. 30, 2012

(86) PCT No.: PCT/PT2012/000041
§ 371 (c)(1),
(2) Date: Apr. 29, 2015

(87) PCT Pub. No.: WO2014/070030
PCT Pub. Date: May 8, 2014

(65) Prior Publication Data

US 2015/0291355 A1 Oct. 15, 2015

(51) Int. Cl.

| | |
|---|---|
| ***B65F 1/12*** | (2006.01) |
| ***B65F 1/14*** | (2006.01) |
| ***B65F 1/16*** | (2006.01) |
| ***B65F 3/02*** | (2006.01) |

(52) U.S. Cl.
CPC ..... *B65F 1/1447* (2013.01); *B65F 1/12* (2013.01); *B65F 1/122* (2013.01); *B65F 1/1457* (2013.01); *B65F 1/1638* (2013.01); *B65F 1/1646* (2013.01); *B65F 3/02* (2013.01); *B65F 2001/1669* (2013.01); *B65F 2210/165* (2013.01); *B65F 2210/172* (2013.01)

(58) Field of Classification Search
CPC ..... B65F 1/1447; B65F 1/122
See application file for complete search history.

(56) References Cited

U.S. PATENT DOCUMENTS

| | | | | |
|---|---|---|---|---|
| 3,250,413 A * | 5/1966 | Kolling | B65F 1/02 414/410 |
| 2008/0203097 A1* | 8/2008 | Cardoso Cabral Martins da Silva | B65F 1/1447 220/484 |
| 2011/0210124 A1* | 9/2011 | Da Silva | B65F 1/1447 220/484 |

* cited by examiner

*Primary Examiner* — Jonathan Snelting
(74) *Attorney, Agent, or Firm* — Mark M. Friedman

(57) ABSTRACT

The present invention describes a subsurface refuse system for side loading collection. It comprises an underground bunker (4), a refuse container (installed with lateral movable arms, a deposit input bin, one internal platform that supports temporarily the container and a cover with automatic opening and closing. All the movements are remotely operated. The container translates and is collected only with an automated side loading lifter installed in the truck.

12 Claims, 8 Drawing Sheets

SUBSURFACE SYSTEM FOR THE COLLECTION OF REFUSE

SUMMARY OF THE INVENTION

The present invention describes a subsurface refuse system for side loading collection. It comprises an underground bunker, a refuse container installed with lateral movable arms, a deposit input bin, one internal platform that supports temporarily the container and a cover with automatic opening and closing. All the movements are remotely operated. The container translates and is collected only with an automated side loading lifter installed in the truck.

Prior Art

There is prior art detailing systems for the underground storage of solid refuse containers.

The subsurface refuse collection systems employ containers that are collected by means of a crane installed in a top loading or rear loading truck or by means of an automatic lifter installed in a side loading collection truck.

Containers for top loading or rear loading collection are placed within an underground bunker located under a cover. After the manual or automatic opening of the cover, the containers are collected using the crane installed on the truck. When the container is positioned above or in the rear end of the collection vehicle, it is opened from below or turned in order to unload the refuse into the vehicle.

Portuguese patents 101968, 102148, 102748, Spanish patents 2036916, 2138480, 2153733, 2228225, 2228226 and WO 2010/041969 exemplify the features of prior art for subsurface refuse collection systems employing containers that are collected by means of a crane.

Other systems use side loading trucks that automatically connect with the container. Subsurface containers for side loading collection are placed within an underground platform located under the cover. Activating the hydraulic cylinder of the platform, the bottom structure ascends, pushes the cover that opens to 90 degrees and the containers (1) are elevated to street level in order to allow the side unload of the refuse into the vehicle.

US Patent US 2008/0203097 and Spanish Patents 200400634, 200501670 and 200600453 exemplify the features of prior art for subsurface refuse collection systems employing containers that are collected by side loading lifters.

The main problems to be solved in the current subsurface systems for side loading collection are: the entire system is heavy and difficult to transport, all the mechanisms installed in the underground hydraulic platform need continuous maintenance and it is impossible to use alternative energy sources due to the power needed to open the entire system.

BRIEF DESCRIPTION OF THE FIGURES

The following description provided to better describe the present invention is based on the attached drawings that without limiting nature represent.

DETAILED DESCRIPTION OF THE INVENTION

Figure 1:
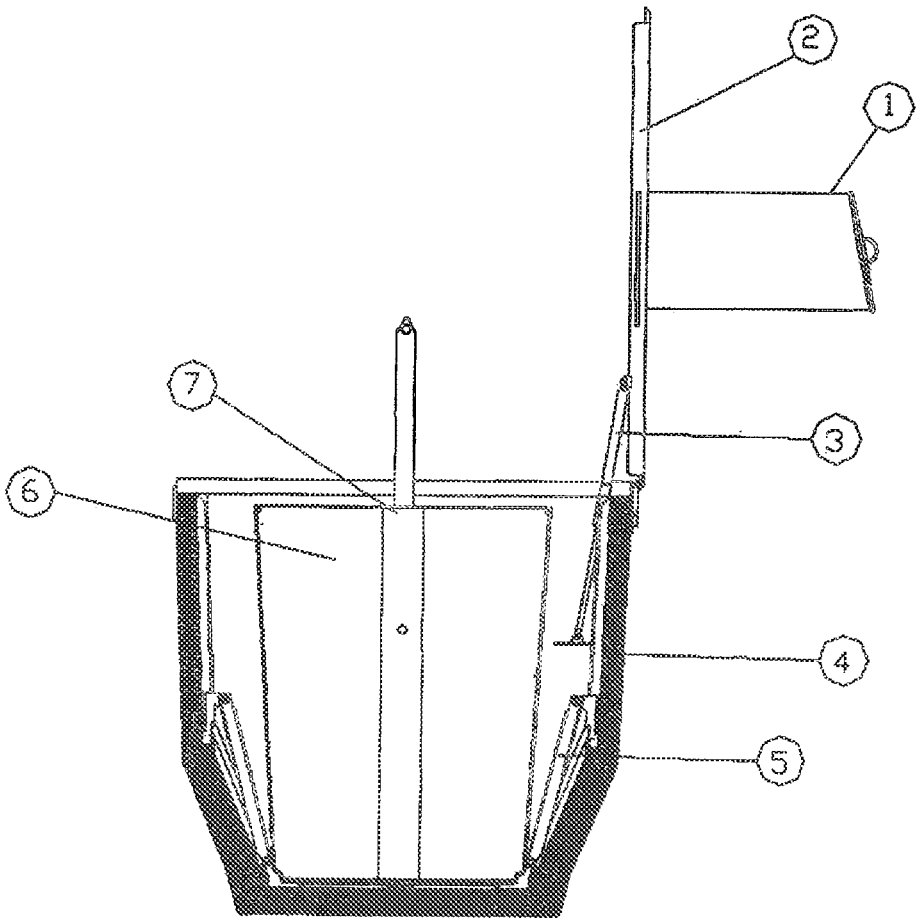
FIG. 1: Schematic section of the subsurface system with the cover totally opened and with the container's lateral movable arms out of the bunker.

The subsurface refuse system for side loading collection as described by the current invention is equipped with a cover (2) supporting the paving which has two or more hinges and opens up to 90 degrees, by means of one or more electric or electro-hydraulic cylinders (3) combined with other gas cylinders.

The gas cylinders and the electric or electro-hydraulic cylinders (3) attached to an underground bunker (4) and to the cover (2) have a driving action system electrically feed to allow the automated opening of the lid up to 90 degrees and also the automated closing. The cylinders (3) electric or electro-hydraulic cylinders may be powered by a solar system comprising one or more photovoltaic panels and the movements of the cover (2) are remotely controlled using a single device by means of continuous control buttons.

On the surface connected with the cover (2) there is an input bin (1) located at a height of around 90 cm to allow the waste deposition.

Inside the underground bunker (4) is located a container (6) for collection of the refuse and one internal platform (5). The internal platform (5) is fixed to the bunker (4) and swings from the initial position connected with the walls of the bunker and to the walls of the container (6) to a horizontal position. The refuse container (6) is collected with a side loading lifter (16) installed in the collection truck (17).

Figure 2:
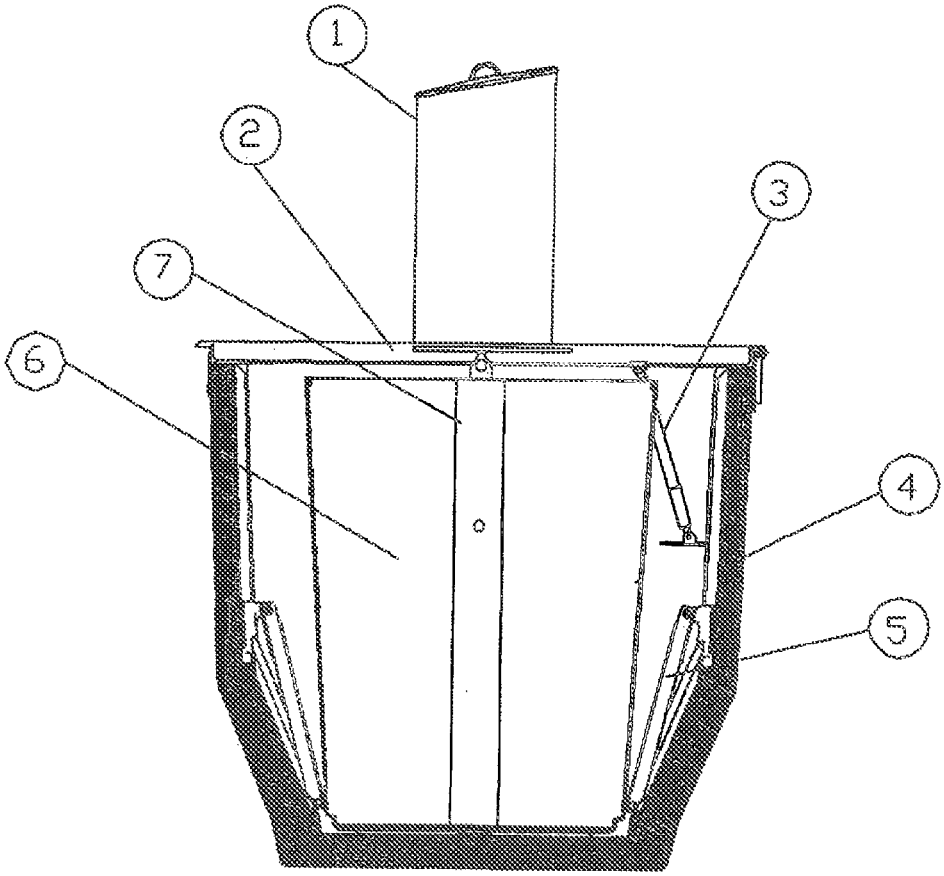
FIG. 2: Schematic section of the subsurface system with the cover in the closed position and with the container is lateral movable arms closed inside the bunker.

FIGS. 1 and 2 shown the subsurface system, comprising a deposit input bin (1), a cover (2) which opens up to 90 degrees, a container (6) for collection of refuse, an underground bunker (4) and an internal platform (5) fixed on the underground bunker (4). The internal platform (5) is positioned between the walls of the bunker (4) and the walls of the container (6).

The container (6) has a mechanism (7) installed on two opposite sides where each one consists of:

- One movable arm (8) with a pin (9) for automatic connection with the side loading lifter (16) and a roller (10) installed at the top of the referred movable arm (8);
- A fixed arm (11) with another pin (12) for another automatic connection with the side loading lifter (16).

Figure 3:
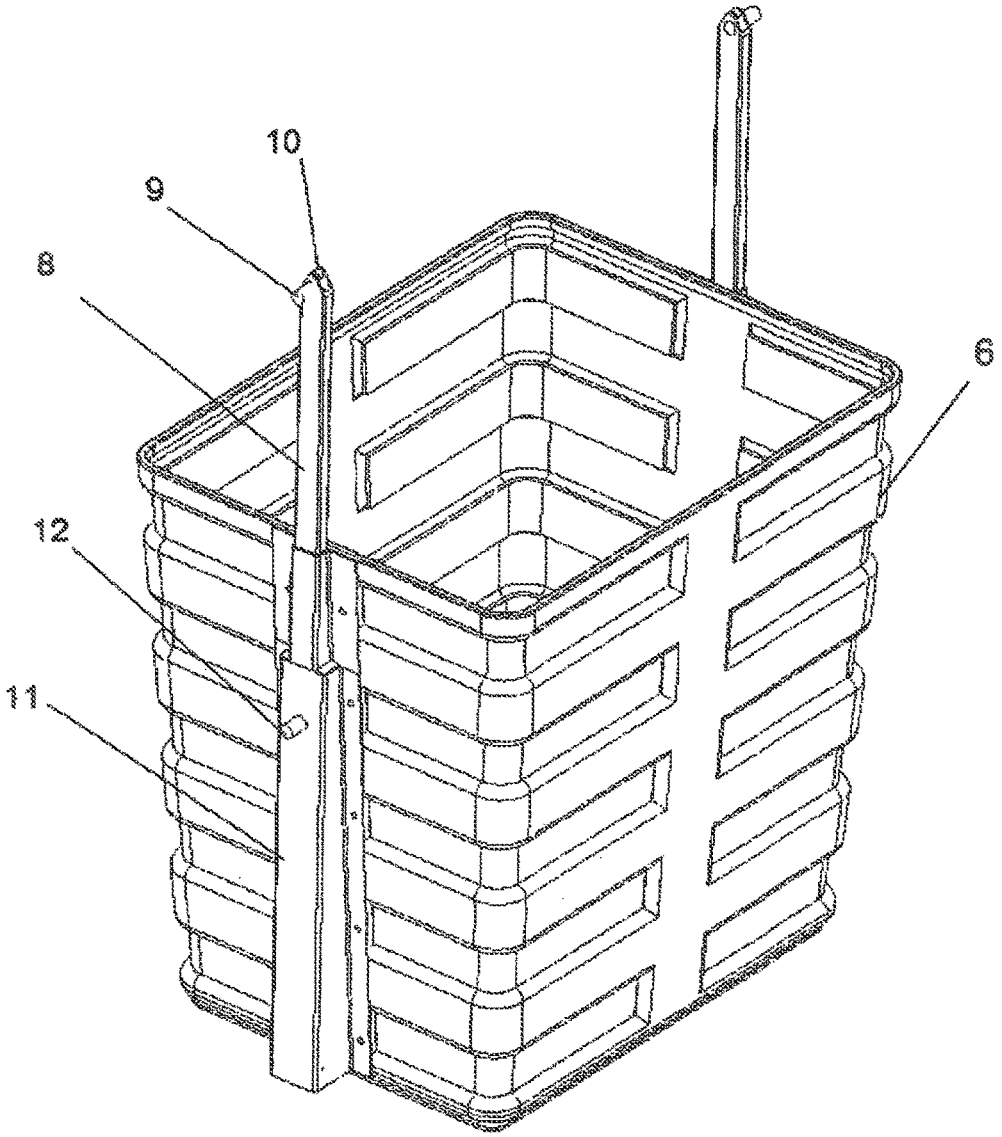
FIG. 3: General view of the refuse container with the lateral mechanisms.

FIGS. 1 and 3 show the container (6) with the container's lateral movable arms (8) opened.

In each mechanism (7) of the container (6) is installed a spring (13) in the interior of the said fixed arm (11) responsible for the mechanism movement:

when the container (6) is inside the bunker (4), due to the weight of the cover (2) that is closed, the movable arm (8) is inside the fixed arm (11) and the spring (13) is compressed;

when the cover (2) is opening, the roller (10) of the movable arm (8) moves on one channel (18) installed in the cover (2), the spring (13) is extended and the movable arm (8) translates vertically out of the bunker.

Figure 4:
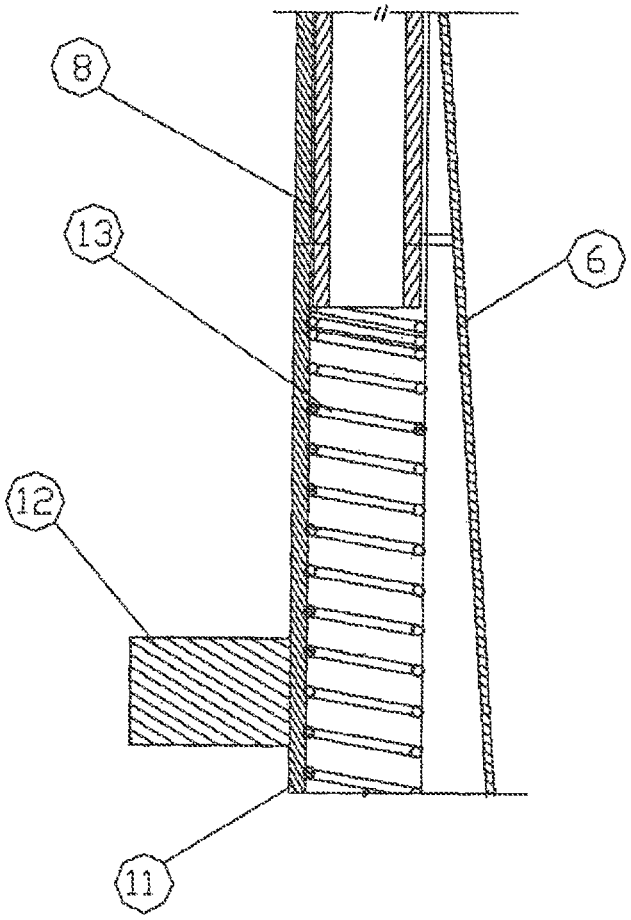
FIG. 4: Detail of the mechanism that allows the vertical translation of the lateral movable arms installed on both sides of the container. The spring installed inside of the fixed arm is starting to be compressed and the movable arm is translating inside the fixed arm.

In FIG. 4 is represented the spring (13) installed inside of the fixed arm (11) and the movable arm (8) translating inside the fixed arm (11).

Figure 5:
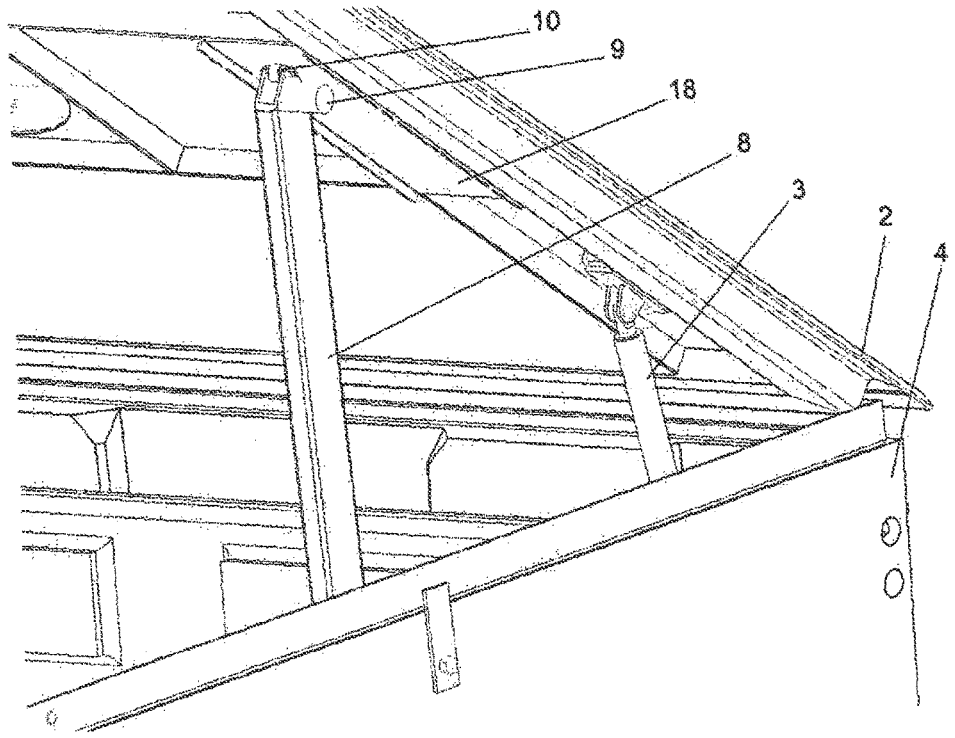
FIG. 5: Detail of the connection between the roller installed in the movable arms of the container and the channel installed in the cover.

In FIG. 5 is represented the connection between the roller (10) installed in the movable arms (8) of the container (6) and the channel (18) installed in the cover (2).

When the two movable arms (8) of the container (6) are positioned outside of the bunker (4), the side loading lifter (16) of the collection truck (17) connects to the pins (9) of the two movable arms (8) in order to lift the container (6).

Figure 6:
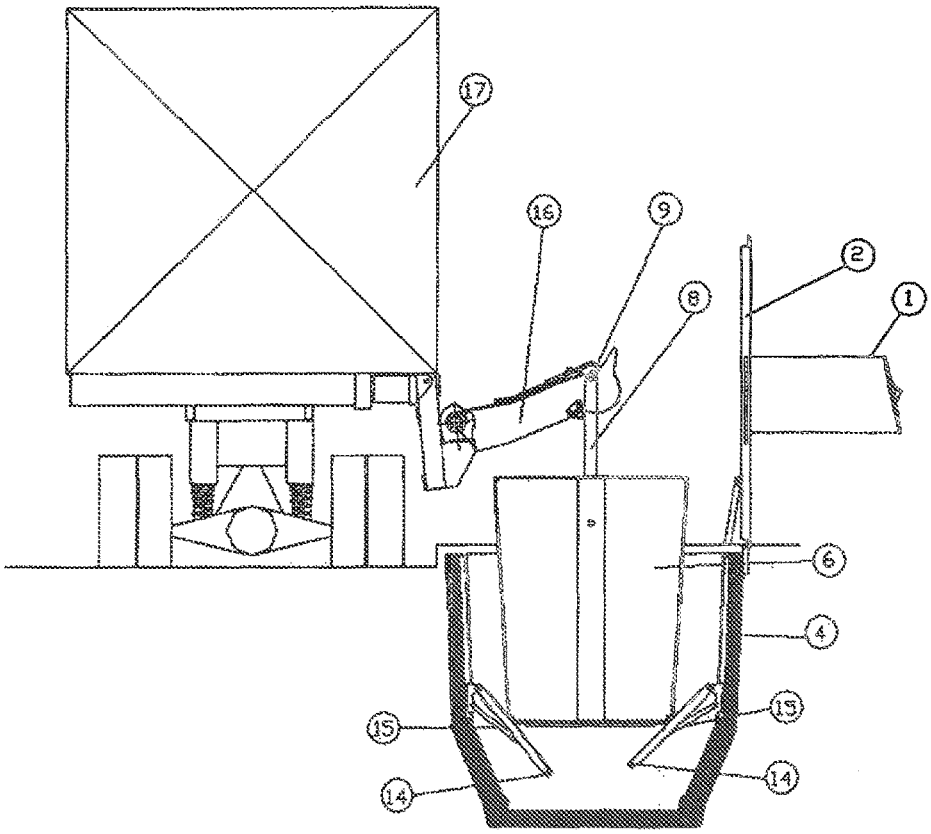
FIG. 6: Schematic section of the subsurface system with the cover in the open position and with the container being lifted inside the bunker by the automatic side loading lifter of the collection truck. The lifter of the truck is connected to the pins installed in the movable arms.

FIG. 6 shows the container (6) being lifted inside the bunker (4) by the automatic side loading lifter (16) of the collection truck (17). The lifter (16) of the truck (17) is connected to the pins (9) installed in the movable arms (8).

During the lifting of the container (6), two movable elements (14) of the internal platform (5), positioned between the walls of the bunker (4) and the walls of the container (6), swing into horizontal position due to the force of a gas shock absorber (15) attached to the bunker (4) and to each of the two movable elements (14). When the two movable elements (14) are in a horizontal position, each one approach in two electromechanical locks (19) attached to the opposite sides of the bunker (4). After the internal platform (5) approach, the side loading lifter (16) disconnects from the pins (9) of the two movable arms (8) in order to release the container (6) into the said internal platform (5) that supports it temporarily.

Figure 8:
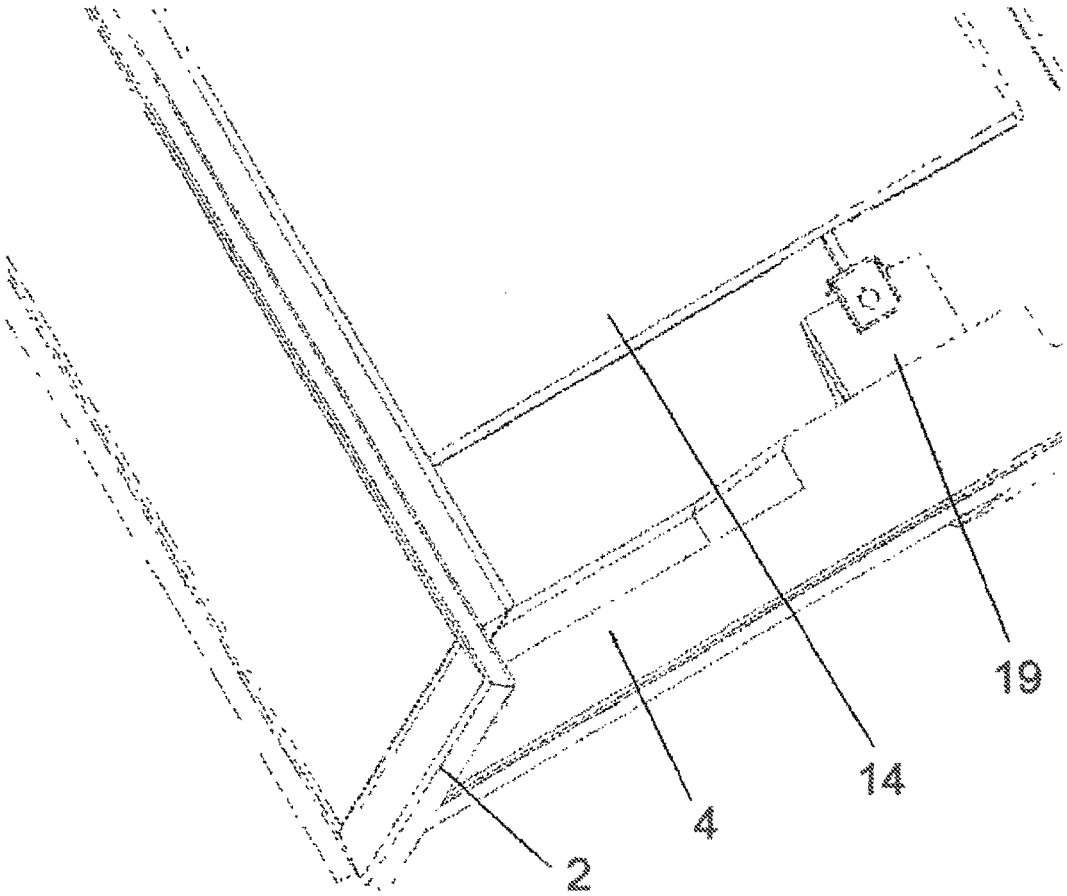
FIG. 8: Detail of one electromechanical lock fixed in the bunker in order to support one of the two movable elements of the internal platform in the horizontal position.

In FIG. 8 it is possible to see one electromechanical lock (19) fixed in the bunker in order to support one side of one movable element (14) of the internal platform (5) in the horizontal position.

When the container (6) is temporarily supported in the internal platform (5), the side loading lifter (16) of the collection truck (17) connects to the pins (12) of the two fixed arms (11) of the container (6) in order to enable the lifting and the turning of the container (6) to be emptied to the collection truck (17).

After emptying, the side loading lifter (16) moves the container (6) to the same position where it was temporarily supported in the internal platform (5) and disconnects from the pins (12) of the two fixed arms (11).

The four electromechanical locks (19) that close the two movable elements (14) and support temporarily the container (6) in the horizontal position are opened by an electric contact in order to permit the gravity vertical movement of the container (6) and the consequent swing of the movable elements (14) of the internal platform (5) against the wall of the bunker (4). The opening of the electromechanical locks (19) is controlled remotely.

Figure 7:
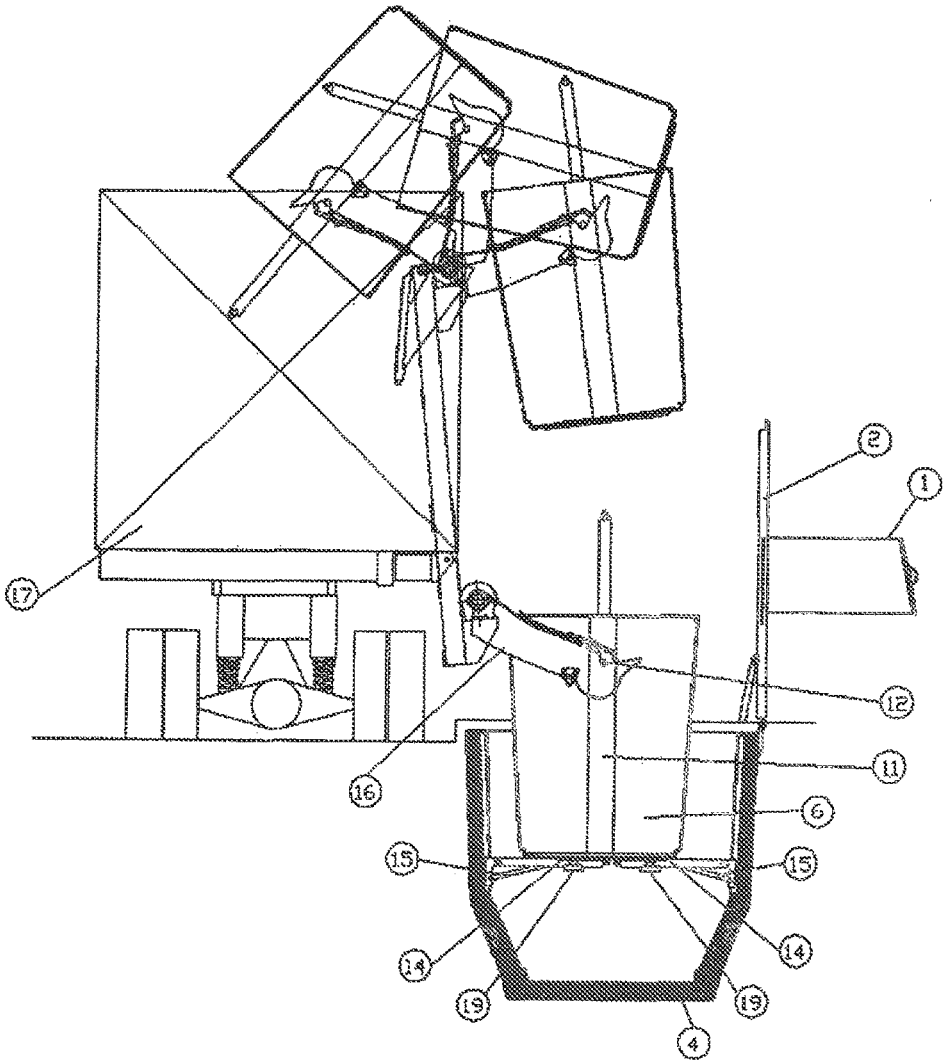
FIG. 7: Schematic section of the subsurface system with the cover in the open position and with the container being loaded by the automatic side loading lifter of the collection truck. The lifter of the truck is connected to the pins installed in the fixed arms in order to unload the refuse into the vehicle.

In FIG. 7 it is possible to verify the container (6) being loaded by the automatic side loading lifter (16) of the collection truck (17). The lifter (16) of the truck (17) is connected to the pins (12) installed in the fixed arms (11) in order to unload the refuse into the vehicle. With the container inside the bunker, the operator controls remotely the electric or electro-hydraulic cylinders to close the cover (2) and consequently the roller (10) of the movable arm (8) moves back on the same channel (18) of the cover (2), the spring (13) is compressed and the movable arm (8) translates vertically in to the inside part of the bunker (4).

As is evident to experts in the field several changes are possible without going beyond the scope of the following claims.

The invention claimed is:

1. A subsurface system for collection of refuse comprising:

various independent modules according to a type of refuse to be collected, comprising, on a surface, a post with an input bin (1), the input bin (1) located at a height of around 90 cm, and a cover (2) supporting a paving, the cover configured to rotate open up to 90 degrees, by means of one or more electric or electro-hydraulic cylinders (3) combined with other gas cylinders, and in a subsurface area, an underground bunker (4), an internal platform (5) and a container (6) for collection of the refuse by means of a side loading lifter (16) of a collection truck (17), wherein the container (6) has a mechanism (7) installed on two opposite sides, wherein each mechanism comprises a movable arm (8) with a pin (9) for automatic connection with the side loading lifter (16) and a roller (10) installed on top of the movable arm (8);

a fixed arm (11) with another pin (12) for another automatic connection with the side loading lifter (16); and wherein the movable arm (8) is positioned within the fixed arm (11).

2. A subsurface system for collection of refuse according to claim 1, wherein between the fixed arm (11) and the movable arm (8) of each of the two mechanisms (7) is installed a spring (13) in an interior of the said fixed arm (11) responsible for a movement mechanism, wherein:

when the container (6) is inside the bunker (4), due to the weight of the cover (2) that is closed, the movable arms (8) are inside the fixed arms (11) and the springs (13) are compressed;

wherein when the cover (2) is opening, the rollers (10) of the movable arms (8) move on a plurality of channels (18) installed in the cover (2), the springs (13) are extended and the movable arms (8) translate vertically out of the bunker; and wherein when the cover is closing, the rollers (10) of the movable arms (8) move back on the plurality of channels (18) of the cover (2), the springs (13) are compressed and the movable arms (8) translate vertically into an inside part of the bunker (4).

3. A subsurface system for collection of refuse according to claim 2, wherein the side loading lifter (16) of the collection truck (17) connects to the pins (9) of the two movable arms (8) that are positioned outside of the bunker (4), when the cover (2) is totally opened, in order to lift of the container (6); when said container (6) passes a horizontal position of the internal platform (5), two movable elements (14) are secured by two electromechanical locks (19) and the side loading lifter (16) disconnects from the pins (9) of the two movable arms (8) in order to release the container (6) into the internal platform (5) that supports it temporarily.

4. A subsurface system for collection of refuse according to claim 1, wherein the internal platform (5) comprises two movable elements (14) which remain stowed against a wall of the bunker (4) when the container (6) is totally inside the bunker (4) and are configured to swing into horizontal position when the container (6) is lifted vertically;

gas shock absorbers (15) attached to the bunker (4) and to each of the two movable elements (14), the gas shock absorbers (15) providing a force that allows an automatic swing of the internal platform (5) when the container (6) is lifted;

electromechanical locks (19) attached to opposite sides of the bunker (4) to allow an approach of the two movable elements (14) in a horizontal position when the container (6) is lifted.

5. A subsurface system for collection of refuse according to claim 4, wherein the side loading lifter (16) of the collection truck (17) connects to the pins (9) of the two movable arms (8) that are positioned outside of the bunker (4), when the cover (2) is totally opened, in order to lift of the container (6) when said container (6) passes a horizontal position of the internal platform (5), the two movable elements (14) are secured by two electromechanical locks (19) and the side loading lifter (16) disconnects from the pins (9) of the two movable arms (8) in order to release the container (6) into the internal platform (5) that supports it temporarily.

6. A subsurface system for collection of refuse according to claim 1, wherein a side loading lifter (16) of the collection truck (17) connects to the pins (9) of the two movable arms (8) that are positioned outside of the bunker (4), when the cover (2) is totally opened, in order to lift the container (6); when said container (6) passes a horizontal position of the internal platform (5), two movable elements (14) are secured by two electromechanical locks (19) and the side loading lifter (16) disconnects from the pins (9) of the two movable arms (8) in order to release the container (6) into the internal platform (5) that supports it temporarily.

7. A subsurface system for collection of refuse according to claim 6, wherein the side loading lifter (16) of the collection truck (17) connects to the pins (12) of the two fixed arms (11) of the container (6) when the container (6) is temporarily supported in the internal platform (5), in order to enable lifting and turning of the container (6) to be emptied to the collection truck (17); wherein said side loading lifter (16) disconnects from the pins (12) of the two fixed arms (11) after emptying when the container (6) returns to a same position where it is temporarily supported in the internal platform (5).

8. A subsurface system for collection of refuse according to claim 6, wherein a plurality of electromechanical locks (19) that close two movable elements (14) and temporarily support the container (6) in a horizontal position can be opened by an electric contact by means of remote control in order to permit a vertical movement of the container (6) due to gravity and a consequent swing of the two movable elements (14) of the internal platform (5) against a wall of the bunker (4).

9. A subsurface system for collection of refuse according to claim 1, and wherein the side loading lifter (16) of the collection truck (17) connects to the pins (12) of the two fixed arms (11) of the container (6) when the container (6) is temporarily supported in the internal platform (5), in order to enable a lifting and a turning of the container (6) to be emptied to the collection truck (17); said side loading lifter (16) disconnects from the pins (12) of the two fixed arms (11) after emptying when the container returns to a same position where it is temporary supported in the internal platform (5).

10. A subsurface system for collection of refuse according to claim 1, and wherein a plurality of electromechanical locks (19) that close two movable elements (14) and temporarily support the container (6) in a horizontal position can be opened by an electric contact by means of remote control in order to permit a vertical movement of the container (6) due to gravity and a swing of the movable elements (14) of the internal platform (5) against a wall of the bunker (4).

11. A subsurface system for collection of refuse according to claim 1, wherein the electro-hydraulic cylinders (3) are powered by a solar system comprising one or more photovoltaic panels and wherein movements of the cover (2) is remotely controlled using a single device by means of continuous control buttons.

12. A subsurface system for collection of refuse according to claim 1, wherein the internal platform (5) comprises two movable elements (14) which remain stowed against a wall of the bunker (4) when the container (6) is totally inside the hunker (4) and are configured to swing into horizontal position when the container (6) is lifted vertically.

* * * * *